United States Patent [19]

Kuroishi et al.

[11] Patent Number: 4,671,491

[45] Date of Patent: Jun. 9, 1987

[54] VALVE-SEAT INSERT FOR INTERNAL COMBUSTION ENGINES AND ITS PRODUCTION

[75] Inventors: Nobuhito Kuroishi; Naoki Motooka, both of Itami; Tetsuya Suganuma; Akira Manabe, both of Toyota, all of Japan

[73] Assignees: Sumitomo Electric Industries, Ltd., Osaka; Toyota Motor Corporation, Toyota, both of Japan

[21] Appl. No.: 743,934

[22] Filed: Jun. 12, 1985

[30] Foreign Application Priority Data

Jun. 12, 1984 [JP] Japan ..... 59-121301
Jun. 12, 1984 [JP] Japan ..... 59-121302

[51] Int. Cl.[4] ..... B21K 1/20; F01L 3/00

[52] U.S. Cl. ..... 251/368; 29/156.7 A; 29/157.1 R; 123/188 S; 428/679

[58] Field of Search ..... 123/188 S; 251/368; 428/679, 681, 539.5; 29/156.7 A, 157.1 A, 157.1 R, 182.1

[56] References Cited

U.S. PATENT DOCUMENTS

| | | | |
|---|---|---|---|
| 2,753,859 | 7/1956 | Bartlett | 123/188 S |
| 2,838,829 | 7/1958 | Goss et al. | 29/149.5 |
| 3,028,850 | 4/1962 | Gleeson | 123/188 S |
| 3,592,440 | 7/1971 | McFarland et al. | 251/170 |
| 3,790,352 | 2/1974 | Niimi et al. | 29/156.7 A |
| 3,795,511 | 3/1974 | Niimi et al. | 29/156.7 A |
| 4,346,684 | 8/1982 | Vossieck | 29/156.7 A |
| 4,422,875 | 12/1983 | Nakata et al. | 123/188 S |
| 4,424,953 | 1/1984 | Takagi et al. | 251/368 |
| 4,546,737 | 10/1985 | Kazuoka et al. | 251/368 |

FOREIGN PATENT DOCUMENTS

| | | | |
|---|---|---|---|
| 0178062 | 10/1983 | Japan | 251/368 |
| 0201908 | 11/1984 | Japan | 123/188 S |

*Primary Examiner*—A. Michael Chambers
*Attorney, Agent, or Firm*—Cushman, Darby & Cushman

[57] ABSTRACT

A valve-seat insert for internal combustion engines comprises a double-layered, sintered alloy composed of a valve-seat layer on which a valve is seated, and a base layer integrated with the valve-seat layer and adapted to be seated in a cylinder head of an engine. The valve-seat layer is composed of a sintered alloy of a high heat resistance and a high wear resistance having a composition comprising, by weight, 4 to 8% Co, 0.6 to 1.6% Cr, 4 to 8% Mo, 1 to 3% Ni, 0.3 to 1.5% C, 0.2 to 0.6% Ca, and the balance of Fe and inevitable impurities, the additives, Co, Cr and Mo being present mainly in a form of a Co-Cr-Mo hard alloy and a hard Fe-Mo alloy dispersed in the Fe matrix. The base layer is composed of a sintered alloy of a higher heat resistance and a higher creep resistance than those of the valve-seat layer and having a composition comprising, by weight, 11 to 15% Cr, 0.4 to 2.0% Mo, 0.05 to 0.3% C, and the balance of Fe and inevitable impurities. At least the valve-seat layer of the double-layered, sintered alloy is being fusion-infiltrated with copper.

4 Claims, 2 Drawing Figures

VALVE-SEAT INSERT FOR INTERNAL COMBUSTION ENGINES AND ITS PRODUCTION

This invention relates to valve-seat inserts for internal combustion engines. More particularly, the present invention relates to valve-seat inserts of a double-layered, sintered alloy that can be applied to high-output, light-weight diesel engines.

In general, valve-seat inserts for internal combustion engines are required to have a high wear resistance not only at room temperature but also at elevated temperatures, a high heat resistance, a high creep strength and a high thermal fatigue strength under repeated impact loadings at elevated temperatures. To meet these requirements, there have been proposed various valve-seat inserts of a double-layered, sintered alloy composed of a valve-seat layer on which a valve is seated, and a base layer integrated with the valve-seat layer and adapted to be seated in a cylinder head of the engine. However, the conventional valve-seat inserts cannot be applied to high-output, lightweight engines which are in the process of development recently.

U.S. Pat. No. 4,346,684 discloses a valve-seat ring of a double-layered, sintered alloy comprising a valve-seat layer of an iron alloy or steel alloy and up to 30% by weight of a nickel and/or cobalt alloy incorporated therein to improve a strength of the valve-seat rings. On the other hand, U.S. Pat. No. 4,424,953 discloses a valve-seat rings of a double-layered, sintered alloy comprising a valve-seat layer including hard alloy particles dispersed in the matrix of valve-seat layer, and a base layer having a stiffness and strength which are equivalent to or greater than those of the valve-seat layer. In order to improve the stiffness and strength of the base layer, a ferrous sintered body is incorporated with at least one element selected from the group consisting of phosphorus and boron. Also, the valve-seat rings of U.S. Pat. No. 4,424,953 is fusion-infiltrated with copper to improve stiffness of the base layer and to reduce thermal load during operation.

The valve-seat inserts of these patents possess excellent characteristics sufficient for use in gasoline engines, but they cannot be applied to diesel engines particularly, to high-output, lightweight engines such as, for example, diesel engines with a turbo-charger. Since the base layer of the valve-seat inserts is generally made of a sintered alloy of Fe-Cu-C or Fe-Cr-C systems, which are poor in heat resistance and creep strength, the interference between the valve-seat ring and a cylinder head become lowered under high temperatures even if the valve-seat inserts are fusion infiltrated with copper.

In the diesel engines, which have a different combustion mechanism from that of the gasoline engines, a temperature of the valve-seat insert rises to about 500° C. at the maximum, which is higher than that of the gasoline engines by about 100° C.

In U.S. application Ser. No. 626,124, now U.S. Pat. No. 4,546,737 issued 12/24/85, three of the inventors, T. Suganuma, N. Kuroishi and N. Motooka, in cooperation with K. Kazuoka, have proposed a valve-seat insert of a double-layered, sintered alloy comprising a valve-seat layer having a sintered alloy, and a base layer of a sintered alloy having a higher heat resistance and a higher creep strength than those of the valve-seat layer. Such valve-seat inserts can be successfully used in high-output, lightweight gasoline engines and also in natural aspiration diesel engines since the use of the sintered alloy with a high heat resistance and a high creep strength as a material for the base layer makes it possible to improve the interference between the valve-seat insert and the cylinder head. However, it has now been found that these valve-seat inserts cannot be applied to the high-output diesel engines such as, for example, diesel engines with a supercharger or a turbo-charger. Since the sintered alloy generally includes pores formed by sintering that communicate with the outside through the pores on its surface, and the combustion at high temperatures causes dissociation of $H_2O$ and $CO_2$, ions produced by dissociation enter into the pores formed in the valve-seat layer, resulting in oxidation of not only the surface of the valve-seat layer but also the interior of the valve-seat layer, and causing decrease of the thermal fatigue strength.

Accordingly, it is required to seal the pores formed in the valve-seat layer to prevent the valve-seat layer from oxidation. It is also required to transfer the heat from the valve-seat layer to the cylinder head to achieve effective cooling of the valve-seat layer.

SUMMARY OF THE INVENTION

It is an object of the present invention to provide a valve-seat insert for internal combustion engines that overcomes the aforesaid disadvantages and fully satisfies the above requirements.

Another object of the present invention is to provide a valve-seat insert for use in internal combustion engines that has a high fatigue strength under thermal stress and retains a tight interference with a cylinder head of the engine under high temperatures.

Still another object of the present invention is to provide a valve-seat insert for internal combustion engines having a high heat resistance, a high creep strength, a high radial crushing strength and a high wear resistance.

Further object of the present invention is to provide a valve-seat insert of a double-layered, sintered alloy suitable for use in high-output diesel engines.

These and other objects of the present invention can be achieved by providing a valve-seat insert for internal combustion engines comprising a double-layered, sintered alloy composed of a valve-seat layer on which a valve is seated, and a base layer integrated with the valve-seat layer and adapted to be seated in a cylinder head of the engine, characterized in that said valve-seat layer is composed of a sintered alloy of a high heat resistance and a high wear resistance, that said base layer is composed of a sintered alloy of a higher heat resistance and a higher creep resistance than the valve-seat layer, and that at least valve-seat layer of the double-layered, sintered alloy is fusion-infiltrated with copper.

DETAILED DESCRIPTION OF THE INVENTION

According to the present invention it has now been found that the requirement for retaining the high interference under high temperatures can be fully met by use of a valve-seat insert of a double-layered, sintered alloy having a radial crushing strength of not less than 90 $kgf/mm^2$ at room temperature, but not less than 70 $kgf/mm^2$ at 500° C., and comprising a base layer consisting essentially of a sintered alloy having a radial crushing strength of not less than 100 $kgf/mm^2$ at room temperature, but not less than 80 $kgf/mm^2$ at 500° C. It has also been found that the fatigue strength under thermal stress can be improved by fusion infiltration of copper into at least valve-seat layer of the valve-seat insert.

A preferred material for the valve-seat layer is a sintered alloy consisting essentially of, by weight, 4 to 8% Co, 0.5 to 1.5% Cr, 4 to 8% Mo, 1 to 3% Ni, 0.3 to 1.5% C, 0.2 to 0.6% Ca, and the balance of Fe and inevitable impurities, said Co, Cr and Mo being present mainly in the form of a Co-Cr-Mo hard alloy and a Fe-Mo hard alloy dispersed in the Fe matrix of the valve-seat layer.

As a material for the base layer it is preferred to use a sintered alloy consisting essentially of, by weight, 11 to 15% Cr, 0.4 to 2.0% Mo, 0.05 to 0.3% C, and the balance of Fe and inevitable impurities.

It is preferred that the content of the infiltrated copper in the valve-seat layer being 7 to 16% by weight with respect to the weight of the valve-seat layer.

In one preferred embodiment of the present invention, a valve-seat insert for internal combustion engines comprises a double-layered, sintered alloy composed of a valve-seat layer on which a valve is seated, and a base layer integrated with said valve-seat layer and adapted to be seated in a cylinder head of an engine, and is characterized in that said valve-seat layer is composed of a sintered alloy consisting essentially of, by weight, 4 to 8% Co, 0.5 to 1.5% Cr, 4 to 8% Mo, 1 to 3% Ni, 0.3 to 1.5% C, 0.2 to 0.6% Ca, and the balance of Fe and inevitable impurities, said Co, Cr and Mo being present mainly in a form of a Co-Cr-Mo hard alloy and a Fe-Mo hard alloy dispersed in the Fe matrix of the valve-seat layer, and that said valve-seat layer being fusion-infiltrated with copper.

In another preferred embodiment of the present invention, a valve-seat insert for internal combustion engines is characterized in that said valve-seat layer is composed of a sintered alloy consisting essentially of, by weight, 4 to 8% Co, 0.6 to 1.5% Cr, 4 to 8% Mo, 1 to 3% Ni, 0.3 to 1.5% C, 0.2 to 0.6% Ca, and the balance of Fe and inevitable impurities, said Co, Cr and Mo being present mainly in a form of a Co-Cr-Mo hard alloy and a Fe-Mo hard alloy dispersed in the Fe matrix of the valve-seat layer, that said base layer is composed of a sintered alloy consisting essentially of, by weight, 11 to 15% Cr, 0.4 to 2.0% Mo, 0.05 to 0.3% C, 2 to 4% Cu, and the balance of Fe and inevitable impurities, and that said valve-seat layer is being fusion-infiltrated with copper.

In a further preferred embodiment of the present invention, a valve-seat insert of a double-layered, sintered alloy for internal combustion engines is characterized in that the valve-seat layer is composed of a sintered alloy consisting essentially of, by weight, 4 to 8% Co, 0.6 to 1.5% Cr, 4 to 8% Mo, 1 to 3% Ni, 0.3 to 1.5% C, 0.2 to 0.6% Ca, and the balance of Fe and inevitable impurities, said Co, Cr and Mo being present mainly in a form of a Co-Cr-Mo hard alloy and a Fe-Mo hard alloy dispersed in the Fe matrix of the valve-seat layer, that said base layer is composed of a sintered alloy consisting essentially of, by weight, 11 to 15% Cr, 0.4 to 2.0% Mo, 0.05 to 0.3% C, 2 to 4% Cu, and the balance of Fe and inevitable impurities, and that both the valve-seat layer and base layer are being fusion-infiltrated with copper. It is preferred that the content of the infiltrated copper in the double-layered sintered alloy being 7 to 14% by weight with respect to the weight of the double-layered, sintered alloy.

In a preferred embodiment, the valve-seat insert comprises a valve-seat layer of a sintered alloy having a density of not less than 7.5 g/cm$^3$, and a base layer of a sintered alloy having a density ranging from 6.6 g/cm$^3$ to 7.1 g/cm$^3$. If the densities of these layers are less than the above respective minimum values, it is difficult to produce a valve-seat insert having a desired mechanical strength and a desired resistance to repeated shock loads. The reason why the density of two layers differ from eacn other is that the density of sintered alloy is sensitive to changes in compositions and compression properties of powder materials. Preferably, the valve-seat and base layers are so formed that the valve-seat layer has a thickness approximately equal to that of the base layer. If the thickness of the valve-seat layer is too thin, it is difficult to produce valve-seat inserts with a high wear resistance, and if the thickness of the base layer is too thin, it is difficult to produce valve-seat inserts with a high heat resistance and a high creep strength. However, the ratio of the thickness between the valve-seat layer and the base layer may be varied to any ratio, if desired.

The reasons why the composition of the sintered alloy for the valve-seat layer has been limited to the above range are as follows: Co, Cr and Mo are added to an Fe matrix in the form of Co-Cr-Mo hard alloy and a Fe-Mo hard alloy to improve the heat resistance and wear resistance. Most of these alloys are dispered in the matrix and present as a hard phase and improves both the heat resistance and wear resistance, while a part of the addition alloy dissolves in the matrix and contributes to improve the heat resistance and to strengthen the bond between the matrix and the hard phase. If the content of Co is less than 4%, or that of Cr is less than 0.5%, or that of Mo is less than 4%, the addition of these additives takes no recognizable effect. If the contents of these additives exceed the above respective maximum values, i.e., 8% for Co, 1.5% for Cr, and 8% for Mo, the hard phase is present too much and causes the valve to wear. For these reasons, the content of Co has been limited to the range of 4 to 8%, the content of Cr has been limited to the range of 0.6 to 1.5%, and the content of Mo has been limited to the range of 4 to 8%.

Ni is added to the Fe matrix to strengthen the ferrite and to improve the toughness of the matrix. If the content of Ni is less than 1%, its addition takes no recognizable effects, and if the content exceeds 3%, it causes an increase of residual austenite in the matrix. Accordingly, the content of Ni has been limited within the range of 1 to 3%.

C dissolves in the matrix and forms pearlite to strengthen the matrix and improve the wear resistance. If the content of C is less than 1%, it is not possible to obtain the desired effects. If the content of C is more than 1.5%, it causes the sintered alloy to embrittle. For these reasons, the content of C has been limited to the range of 1 to 3%.

Ca is added to the matrix in the form of $CaF_2$ to improve a self-lubricating properties of the valve-seat layer and to improve a resistance to sliding abrasive wear and the machinability. If the content of Ca is less than 0.2%, its addition takes no recognizable effects. If the Ca content exceeds 0.6%, the properties of the alloy are not improved any more and excess Ca causes lowering of the mechanical strength. Thus, the content of Ca has been limited to the range of 0.2 to 0.6%.

The reasons why the composition of the sintered alloy for the base layer have been limited to the above range are as follows: Cr dissolves in the matrix and contributes to strengthen the matrix and to improve the heat resistance. If the content of Cr is less than 11%, it is not possible to obtain the desired effects. The heat resistance increases with increase of the content of Cr, but it reached to the maximum at the content of 15% and is not improved any more even if the Cr content exceeds 15%. Thus, the Cr content has been limited within the range of 11 to 15%.

Mo, a carbide-forming element, is added to the matrix to strengthen the same and to improve the heat resistance and creep strength. If the Mo content is less than 0.4%, it is not possible to obtain the desired properties. If the Mo content exceeds 2.0%, it cannot improve the properties any more and causes an increase of manufacturing cost.

C forms carbides with Mo, Fe and Cr and contributes to strengthen the matrix. If the content of C is less than 0.05%, it is not possible to obtain the desired effects and, if the content exceeds 0.3%, it causes embrittlement of the base layer and lowering of its mechanical strength.

The valve-seat insert of a double-layered, sintered alloy, of which only the valve-seat layer is fusion-infiltrated with copper, may be produced by a process comprising the steps of separately preparing a mixture of raw materials for the valve-seat layer and a mixture of raw materials for the base layer, pre-compacting the mixture for the base layer, compacting the same together with the mixture for the valve-seat layer to form a double-layered green compact, sintering the green compact in a neutral or reducing atmosphere, and then heating the resultant double-layered sintered body together with copper in a converted gas atmosphere to selectively infiltrate copper into the valve-seat layer by fusion.

The fusion infiltration in the converted gas atmosphere makes it possible to selectively infiltrate copper into the valve-seat layer of the double-layered sintered body which is composed of a base layer containing Cr in an amount of 11 to 15% by weight, and a valve-seat layer containing Cr in an amount of not more than 1.5% of Cr. In the converted gas atmosphere, the surface of the base layer is slightly oxidized because of a large amounts of Cr which is an easily oxidizable alloying element, resulting in the decrease of wettability with the fused copper, while that of the valve-seat layer is not oxidized and retains its good wettability with the fused copper.

The copper fusion infiltration is preferably carried out with a continuous furnace of a conveyor belt type in a converted gas atmosphere at a temperature ranging from 1100° to 1150° C. Copper is placed on the surface of the valve-seat layer of the double-layered sintered alloy and then infiltrated into the valve-seat layer by fusion. The infiltration temperature has been limited as being within the above range for the following reasons. If the fusion-infiltration temperature is less than 1100° C., it is difficult to uniformly infiltrate copper into the valve-seat layer since the melting point of copper is 1083° C. If the fusion-infiltration temperature is higher than 1150° C., a life of the conveyor belt become shortened.

On the other hand, the valve-seat insert of a double-layered, sintered alloy, of which both the valve-seat layer and the base layer are fusion-infiltrated with copper, may be produced by a process comprising the steps of separately preparing a mixture of raw materials for the valve-seat layer and a mixture of raw materials for the base layer, pre-compacting the mixture for the base layer, compacting the same together with the mixture for the valve-seat layer to form a double-layered green compact, sintering the green compact in a neutral or reducing atmosphere, and then heating the resultant double-layered sintered body together with copper in a non-oxidizing atmosphere such as hydrogen gas, nitrogen gas, converted ammonia gas, and the like. In this case, the copper fusion infiltration is preferably carried out at a temperature ranging from 1100° to 1180° C. If the infiltration temperature is less than 1100° C., it is difficult to uniformly infiltrate copper into the double-layered sintered alloy since the melting point of copper is 1083° C. If the infiltration temperature is higher than 1180° C., the wear resistance of the insert become lowered because of diffusion of Co-Mo-Cr hard phase in the valve-seat layer into the matrix.

According to the present invention, it is possible to produce a valve-seat insert having tight interference against the cylinder head of the engine and a high thermal fatigue strength under repeated impact loadings at elevated temperatures, as well as a high wear resistance not only at room temperature but also at elevated temperatures and a high heat resistance. Also, it is possible to obtain valve-seat inserts having a radial crushing strength of not less than 90 kgf/mm$^2$ at room temperature, but not less than 70 kgf/mm$^2$ at 500° C., and consisting of a double-layered sintered alloy comprising a base layer with a radial crushing strength of not less than 100 kgf/mm$^2$ at room temperature, but not less than 80 kgf/mm$^2$ at 500° C.

The invention will be further apparent from the following description with reference to examples thereof and the accompanying drawings.

BRIEF DESCRIPTION OF THE DRAWINGS

Referring now to FIG. 1, there is shown a valve-seat insert according to the present invention. The valve-seat insert 1 is pressed in a cylinder head 4 of a diesel engine and subjected to a valve-spring force when a valve 5 is seated. The valve-seat insert 1 consists of a double-layered, sintered alloy comprising a valve-seat layer 2 and a base layer 3 which have been integrated by sintering.

PRELIMINARY EXAMPLE 1

Figure 1:
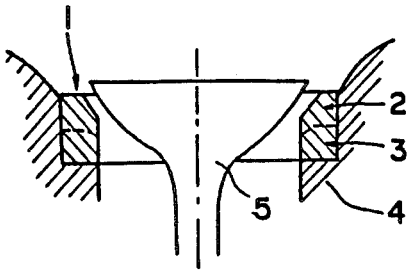
FIG. 1 is a schematic sectional view of a valve-seat insert according to the present invention, pressed in a cylinder head of diesel engine.

Using powders of an Fe-Cr alloy (13 wt % Cr), atomized iron, Co, Mo(or $Mo_2C$), Ni, a Co-Cr-Mo alloy (Co-30% Mo-10% Cr), graphite, ferromolybdenum, Cu and $CaF_2$ as raw materials, there were prepared powder mixtures for sintered alloys each having a composition shown in Table 1. Minus sieves of 100 mesh screens were used for powders of the Fe-Cr alloy, atomized iron, Co, Mo(or $Mo_2C$), Ni, Co-Cr-Mo alloy, graphite, Cu and $CaF_2$, while minus sieves of a 200 mesh screen were used for powder of ferromolybdenum. The resultant mixture was compacted to rings having dimensions 40 mm (outside diameter)×27 mm (inside diameter)×10 mm (thickness) under a pressure of 6.5 t/cm$^2$ and then sintered at 1200° C. for 30 minutes in a neutral or reducing atmosphere to prepare sintered alloy rings. Specimens Nos. 1, 2, 3 and 9 of the sintered alloy rings were infiltrated with copper in a converted gas atmosphere at 1130° C. for 30 minutes.

The resultant specimens were subjected to measurement of the radial crushing strength both at room temperature and at an elevated temperature of 500° C. The results are shown in Table 1.

In Table 1, specimens Nos. 1 to 3 are those having a composition used for the valve-seat layer of the valve-seat inserts according to the present invention, and a specimen No. 4 is the one having a composition used for the base layer of the valve-seat inserts according to the present invention. Specimens Nos. 5 to 9 are those composed of comparative sintered alloys.

TABLE 1

| Specimen No. | composition (weight %) | Amount of infiltrated copper (wt %) | Density | Radial crushing strength (kgf/mm²) Room Temp. | At 500° C. |
|---|---|---|---|---|---|
| 1 | Fe—2Ni—4Co—0.7Cr—5Mo—0.8C—0.4Ca | 14.6 | 7.75 | 125 | 102 |
| 2 | Fe—2Ni—5Co—1Cr—6Mo—0.8C—0.4Ca | 14.7 | 7.76 | 128 | 106 |
| 3 | Fe—2Ni—7Co—1.2Cr—7Mo—0.8C—0.4Ca | 15.2 | 7.81 | 129 | 109 |
| 4 | Fe—12Cr—0.9Mo—0.1C | 0 | 6.80 | 119 | 100 |
| 5 | Fe—2Ni—4Co—0.7Cr—5Mo—0.8C—0.4Ca | 0 | 6.86 | 90 | 75 |
| 6 | Fe—2Ni—5Co—1Cr—6Mo—0.8C—0.4Ca | 0 | 6.89 | 94 | 79 |
| 7 | Fe—2Ni—7Co—1.2Cr—7Mo—0.8C—0.4Ca | 0 | 6.90 | 95 | 81 |
| 8 | Fe—12Cr—0.9Mo—0.1C | 0 | 6.77 | 124 | 106 |
| 9 | Fe—3Cu—1C | 15.0 | 7.80 | 105 | 76 |

From the results shown in Table 1, it will be seen that the sintered alloys used in the present invention have a high strength and a high heat resistance as compared with the comparative sintered alloys. Also, from the comparison of the specimen No. 4 with the specimen No. 8, it will be seen that the specimen 4 has been scarcely fusion infiltrated with copper and has a density approximately equal to that of the specimen No. 8 even though the former has been subjected to fusion infiltration with copper.

EXAMPLE 1

Using raw materials used in Example 1, there were prepared powder mixtures for the valve-seat layer and base layer each having a composition shown in Table 2. Each of the resultant mixtures for the base layer was pre-compacted, and then compacted together with the mixture for tne valve-seat layer under a pressure of 6.5 t/cm² to prepare green compacts of a double-layered valve-seat insert with dimensions of 37 mm (outside diameter)×30 mm (inside diameter)×6 mm(thickness). The resultant green compacts were sintered in a neutral or reducing atmosphere at 1200° C. for 30 minutes to produce valve-seat insert rings consisting of a double-layered, sintered alloy. The specimens Nos. 1 and 3 were infiltrated by heating the same together with copper in a converted gas atmosphere at 1130° C. for 30 minutes.

The thus produced valve-seat inserts were subjected to durability tests on the diesel engine having four cylinders and total displacements of 2000 cc. The inserts were pressed in a cylinder head of a diesel engine under the initial interference of 80 microns, as shown in FIG. 1. The engine was run at 4000 rpm for 400 hours. After 400 hours running, a load required for ejecting the insert from the head was measured to determine the heat resistance and creep strength of the insert. The weight of the rings were measured before and after running test to determine an increase of the weight due to oxidation of the alloys. The results are also shown in Table 2.

TABLE 2

| Specimen No. | composition of valve-seat layer (weight %) | Composition of base layer (weight %) | Ejecting load (kg) | Increase of weight (weight %) |
|---|---|---|---|---|
| 1 | Fe—2Ni—5Co—1Cr—6Mo—0.8C—0.4Ca | Fe—13Cr—0.9Mo—0.1C | 800 | 0.44 |
| 2 | " | Fe—13Cr—0.9Mo—0.1C | 510 | 1.47 |
| 3 | " | Fe—3Cu—1C | 650 | 0.32 |

From the results shown in Table 2, it will be seen that the valve-seat insert No. 1 according to the present invention have a high ejecting load as compared with the comparative valve-seat rings Nos. 2 and 3. Also, the requirements for the characteristics of the valve-seat inserts for the diesel engines are fully met by the valve-seat inserts according to the present invention that have a high heat resistance and a high creep strength.

Figure 2:
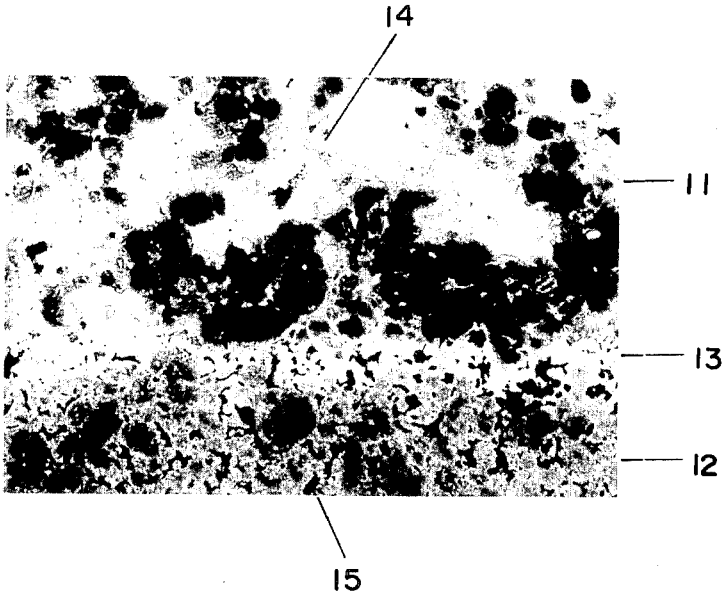
FIG. 2 is a photomicrograph showing microstructure (magnifications of 200) of the valve-seat inserts according to the present invention at its cross section.

FIG. 2 shows a photomicrograph showing a micro structure of the valve-seat ring of No. 1 including a valve seat layer 11, a base layer 12, a boundary 13 between them and pores 15 formed by sintering. From this figure, it will be seen that the valve-seat layer 11 is fusion infiltrated with copper 14, while the base layer 12 is not infiltrated with copper and that the copper 14 is selectively infiltrated into the valve-seat layer 11.

PRELIMINARY EXAMPLE 2

Using powders of an Fe-Cr alloy (13wt % Cr), atomized iron, Co, Mo(or $Mo_2C$), Ni, a Co-Cr-Mo alloy (Co-30% Mo-10% Cr), graphite, ferromolybdenum, Cu and $CaF_2$ as raw materials, there were prepared powder mixtures for sintered alloys each having a composition shown in Table 3. Minus sieves of 100 mesh screens were used for powders of the Fe-Cr alloy, atomized iron, Co, Mo(or $Mo_2C$), Ni, Co-Cr-Mo alloy, graphite, Cu and $CaF_2$, while minus sieves of a 200 mesh screen were used for powder of ferromolybdenum. The resultant mixture was compacted to rings having dimensions 40 mm (outside diameter)×27 mm (inside diameter)×10 mm (thickness) under a pressure of 6.5 t/cm² and then sintered at 1200° C. for 30 minutes in a neutral or reducing atmosphere to prepare sintered alloy rings. Specimens Nos. 1, 2, 3, 4 and 8 of the sintered alloy rings were infiltrated with copper by heating them together with copper in a nitrogen gas atmosphere at 1160° C. for 30 minutes.

The resultant specimens were subjected to measurement of the radial crushing strength both at room temperature and at an elevated temperature of 500° C. The results are shown in Table 3.

In Table 3, specimens Nos. 1 to 3, 5 and 6 are sintered alloys used for the base layer of the valve-seat inserts according to the present invention, and a specimen No. 4 is the one used for the valve-seat layer of the valve-seat inserts according to the present invention. Specimens Nos. 7 and 8 are comparative sintered alloys.

TABLE 3

| Specimen No. | composition (weight %) | Amount of infiltrated copper (wt %) | Radial crushing strength (kgf/mm²) Room Temp. | At 500° C. |
|---|---|---|---|---|
| 1 | Fe—12Cr—0.9Mo—0.1C | 13.4 | 150 | 114 |
| 2 | Fe—11Cr—0.6Mo—0.05C | 14.0 | 147 | 110 |
| 3 | Fe—Cr—0.9Mo—0.3C | 13.1 | 141 | 112 |
| 4 | Fe—2Ni—5Co—1Cr—6Mo—0.8C—0.4Ca | 14.8 | 129 | 105 |
| 5 | Fe—11Cr—0.6Mo—0.05C | 0 | 118 | 89 |
| 6 | Fe—13Cr—0.9Mo—0.3C | 0 | 107 | 105 |
| 7 | Fe—2Ni—5Co—1Cr—6Mo—0.8C—0.4Ca | 15.0 | 94 | 79 |
| 8 | Fe—3Cu—1C | xxx | 105 | 76 |

From the results shown in Table 3, it will be seen that the sintered alloys used in the present invention have a high strength and a high heat resistance as compared with the comparative sintered alloys.

EXAMPLE 2

Using raw materials used in Example 2, there were prepared powder mixtures for the valve-seat layer and base layer each having a composition shown in Table 4. Each of the resultant mixtures for the base layer was pre-compacted, and then compacted together with the mixture for the valve-seat layer under a pressure of 6.5 t/cm² to prepare green compacts of a double-layered valve-seat insert with dimensions of 37 mm (outside diameter)×30 mm (inside diameter)×6 mm(thickness). The resultant green compacts were sintered in a neutral or reducing atmosphere at 1200° C. for 30 minutes to produce valve-seat insert rings consisting of a double-layered, sintered alloy. The specimens Nos. 1 and 3 were subjected to fusion infiltration by heating the same together with copper in a converted gas atmosphere at 1130° C. for 30 minutes.

Each of the thus produced valve-seat rings were mounted in a cylinder head of a diesel engine having four cylinders and total displacements of 2000 cc under the initial interference of 80 microns, as shown in FIG. 1. The durability test was carried out by running the engine at 4000 rpm for 400 hours. After 400 hours running, a load required for ejecting the insert from the head was measured to determine the heat resistance and creep strength of the insert. The weight of the rings were measured before and after durability test to determine an increase of the weight due to oxidation of the alloys. The results are also shown in Table 4.

From the results shown in Table 4, it will be seen that the valve-seat rings (Specimen Nos. 1 and 2) according to the present invention have a high ejecting load. This means that the valve-seat rings of the present invention have a high heat resistance and high creep strength, as compared with the comparative valve-seat rings (Specimen Nos. 3 to 5).

TABLE 4

| Specimen No. | composition of valve-seat layer (weight %) | Composition of base layer (weight %) | Ejecting load (kg) | Increase of weight (weight %) |
|---|---|---|---|---|
| 1 | Fe—2Ni—5Co—1Cr—6Mo—0.8C—0.4Ca | Fe—13Cr—0.9Mo—0.1C | 900 | 0.06 |
| 2 | " | Fe—11Cr—0.6Mo—0.05C | 860 | 0.07 |
| 3 | " | Fe—13Cr—0.9Mo—0.1C | 520 | 1.42 |
| 4 | " | Fe—11Cr—0.6Mo—0.05C | 490 | 1.50 |
| 5 | " | Fe—3Cu—1C | 650 | 0.32 |

What we claim is:

1. A double-layered, sintered alloy valve-seat insert, having a radial crushing strength of not less than 90 kgf/mm² at room temperature, but not less than 70 kgf/mm² at 500° C., for an internal combustion engine comprising:

a valve-seat layer consisting essentially of, by weight, 4 to 8% Co, 0.5 to 1.5% Cr, 4 to 8% Mo, 1 to 3% Ni, 0.3 to 1.5% C, 0.2 to 0.6% Ca, and the balance of Fe and inevitable impurities, said Co, Cr and Mo being present mainly in the form of a Co-Cr-Mo hard alloy and a Fe-Mo hard alloy dispersed in the Fe matrix of the valve-seat layer, said valve-seat layer being fusion-infiltrated with copper 7 to 16% by weight of the valve-seat layer, and said valve-seat layer being composed of a sintered alloy of a high heat resistance and a high wear resistance;

a base layer composed of a sintered alloy integrated with the valve-seat layer, adapted to be seated in a cylinder head of the engine, having a radial crushing strength of not less 100 kgf/mm² at room temperature, but not less than 80 kgf/mm² at 500° C., and having a higher heat resistance and a higher creep resistance than the valve-seat layer.

2. A valve-seat insert according to claim 1 wherein the base layer is composed of a sintered alloy consisting essentially of, by weight, 11 to 15% Cr, 0.4 to 2.0% Mo, 0.05 to 0.3% C, and the balance of Fe and inevitable impurities.

3. A valve-seat insert according to claim 1 wherein the sintered alloy of the valve-seat layer has a density of not less than 7.5 g/cm³, and wherein a sintered alloy of the base layer has a density ranging from 6.6 g/cm³ to 7.1 g/cm³.

4. A valve-seat insert according to claim 1 wherein said base layer is composed of a sintered alloy consisting essentially of, by weight, 11 to 15% Cr, 0.4 to 2.0% Mo, 0.05 to 0.3% C, 2 to 4% Cu, and the balance of Fe and inevitable impurities, and wherein both the valve-seat layer and base layer are fusion-infiltrated with copper 7 to 16% by weight of the double-layered, sintered alloy.

* * * * *